US005829270A

United States Patent [19]

Mikheev

[11] Patent Number: 5,829,270

[45] Date of Patent: Nov. 3, 1998

[54] CRYOGENICS

[75] Inventor: Vladimir Andreyevich Mikheev, Bicester, United Kingdom

[73] Assignee: Oxford Instruments (UK) Limited, Oxon, United Kingdom

[21] Appl. No.: 848,296

[22] Filed: Apr. 29, 1997

[30] Foreign Application Priority Data

May 3, 1996 [GB] United Kingdom ..... 9609311

[51] Int. Cl.[6] ..... F25J 1/00

[52] U.S. Cl. ..... 62/610

[58] Field of Search ..... 62/610

[56] References Cited

U.S. PATENT DOCUMENTS

| | | | |
|---|---|---|---|
| 2,982,106 | 5/1961 | Ambler . | |
| 4,672,823 | 6/1987 | Benoit et al. | 62/610 |
| 4,713,942 | 12/1987 | Hofmann | 62/610 |
| 5,339,649 | 8/1994 | Kawai et al. | 62/46.1 |
| 5,542,256 | 8/1996 | Batey et al. | 62/610 |

FOREIGN PATENT DOCUMENTS

| | | |
|---|---|---|
| 27 44 346 A1 | 4/1979 | Germany . |
| 1252620 | 8/1986 | U.S.S.R. . |
| 2 166 535 A | 5/1986 | United Kingdom . |

OTHER PUBLICATIONS

E.T. Swartz, Review of Scientific Instruments, *Charcoal–Pumped the Cryostats for Storage Dewars*, vol. 58, No. 5, May 1987, pp. 881–889.

V. Stepankin, V. Trofinov, B.S. Neganov, Cryogenics, *Compact Universal 3HE and 4HE Charcoal Pumped Insertable Cryostat*, vol. 34, 1994 pp. 247–250.

Velentin N. Pavlov, Cryogenics, *Precooling of a Dilution Refrigerator*, vol. 34, 1994, pp. 239–241.

V.N. Pavlov, B.S. Neganov, J. Konicek and J. Ota, Cryogenics, *A Combined 3HE–4HE Dilution Refrigerator*, Feb. 1978, vol. 18, No. 2, pp. 115–119.

W.R. Wilkes, Cryogenics, *A 200 mW Recirculating Helium–3 Refrigerator*, Jun 1972, vol. 12, No. 3, pp. 180–183.

V.F. Troitskii, A.B. Fradkiv, Instruments and Experimental Techniques, *Portable 3HE Refrigerator*, Mar.–Apr. 1984, vol. 27, No. 2, part 2, pp. 483–486.

*Primary Examiner*—Ronald C. Capossela

[57] ABSTRACT

A refrigerator for cooling a sample comprises a container for holding liquid helium refrigerant to cool the sample. First cooling means is provided for cooling a condensation region with liquid helium coolant whereby helium refrigerant condenses on the condensation region and collects in the container. A sorption pump pumps gaseous helium refrigerant from the container. Second cooling means is provided for cooling the sorption pump with the liquid helium coolant. The first and second cooling means are connected in series with a source of the liquid helium coolant.

13 Claims, 6 Drawing Sheets

CRYOGENICS

FIELD OF THE INVENTION

The present invention relates to improvements in cryogenic refrigeration.

DESCRIPTION OF THE RELATED ART

A number of known cryogenic systems are available for obtaining "ultra-low" temperatures—typically in the range of 1mK–1.5K. One example of such a system is a dilution refrigerator, which uses the two isotopes of helium ($^3$He and $^4$He ) to produce temperatures of 5mK or below. An alternative system is known as a $^3$He refrigerator which uses the boiling of $^3$He to provide cooling for an experiment. Temperatures as low as 0.3K may be achieved by this type of system. Some $^3$He refrigerators are single shot sorption pumped systems, whilst others circulate the gas on a continuous basis, using a room temperature pumping system.

An example of a conventional $^3$He refrigerator is illustrated in FIG. 1. A number of elements of the system have been omitted in the interests of clarity. The system comprises an evacuated insert 1 which is immersed in a $^4$He bath 2 at approximately 4.2K. The insert 1 contains inter alia, a $^3$He pot 3 containing liquid $^3$He 4 in use and, a $^3$He filling/pumping tube 5 which is filled via a $^3$He filling tube 6 connected to a $^3$He storage dump (not shown) via a suitable valve. The liquid helium bath 2 is mounted in a suitable cryostat. A sample 7 is mounted in vacuum on the base of the $^3$He pot 3. A $^4$He "1K pot" 8 is mounted to the $^3$He tube 5 such that it conducts heat away from the walls of the tube 5 in the positions indicated at 9. The 1K pot 8 is filled with liquid $^4$He 10 by an inlet tube 11 which is immersed in the liquid helium bath 2 and includes a needle valve 12 (or any other fixed impedance). The vapour of liquid $^4$He 10 in the 1K pot is pumped to a low pressure by a rotary pump attached to exhaust tube 13 to reduce its temperature. The 1K pot 8 is filled continuously through the variable flow needle valve 12, set for the required flow rate. By pumping off the $^4$He vapour above the liquid $^4$He 10, the temperature of the liquid He 10 is reduced to 1–2K.

The insert 1 also contains a sorption pump (or sorb) 14. The sorption pump is a vacuum pump which works by adsorbing gas. The adsorbent material is usually charcoal (or other material with a very large surface area). When the sorb 14 is warmed, it releases gas, and when it is cooled again it pumps (i.e. adsorbs) the gas to a pressure dependent upon the temperature. A very high (and clean) vacuum can be achieved by this type of pump. The sorb 14 is cooled by a heat exchanger 15 which is fed with $^4$He from the helium bath 2 via inlet tube 16 and needle valve 17. The $^4$He flows through the heat exchanger 15 controlled by valve 17 and exits via exhaust tube 18, which may also be fitted with a suitable pump. The sorb 14 may also be fitted with a heater (not shown).

Typical operation of the sorption pump $^3$He refrigerator system of FIG. 1 is illustrated in FIGS. 2A and 2B, which illustrate the insert 1 only. When the sample 7 has been mounted and the insert 1 has been cooled to approximately 4.2K, the 1K pot 8 is pumped and the needle valve 12 is opened slightly to allow liquid helium to flow into the pot 8, cooling it to below 1.5K. The sorb 14 is warmed above 40K by the heater so that it will not adsorb $^3$He gas (or will release adsorbed gas). The $^3$He gas is free to condense on the 1K pot assembly 8 and runs down to cool the $^3$He pot 3 and sample 7. The flow of $^3$He in this situation is illustrated in FIG. 2A. After a period of time, most of the $^3$He gas should have condensed to give liquid $^3$He 10 in the $^3$He pot 3. At this stage the $^3$He pot 3 is nearly full of liquid $^3$He at approximately 1.5K.

The sorb 14 is now cooled, and it begins to reduce the vapour pressure of the liquid $^3$He 10 so that the sample temperature drops. The flow of $^3$He in this situation is illustrated in FIG. 2B. A base temperature below 0.3K can typically be achieved in this type of cryostat, with no experimental heat load. The 1K pot valve 12 is then set to fill continuously.

SUMMARY OF THE INVENTION

In accordance with the present invention there is provided a refrigerator for cooling a sample comprising a container for holding liquid helium refrigerant to cool the sample, first cooling means for cooling a condensation region with liquid helium coolant whereby helium refrigerant condenses on the condensation region and collects in the container, a sorption pump adapted to pump gaseous helium refrigerant from the container, and second cooling means for cooling the sorption pump with the liquid helium coolant, characterised in that the first and second cooling means are connected in series with a source of the liquid helium coolant.

The refrigerator according to the present invention provides a number of advantages over conventional refrigerators. Firstly, by providing both cooling means on the same helium coolant line, only a single needle valve or fixed impedance (for controlling the flow of helium coolant) is required for both cooling means. Secondly, since both cooling means are provided with helium coolant (typically liquid $^4$He) at substantially the same temperature, the sorb can be cooled to a lower temperature than in a conventional device. Since the pumping efficiency of a sorb is related to its temperature, this increases the pumping power of the sorb for a given volume of adsorbent material. As a result the sorb volume can be reduced. By pumping off gaseous $^4$He from the cooling means, the temperature of the helium coolant can be reduced (in a similar manner to the "1K pot" previously described) to 1–2K. As a result the sorb can be cooled well below the 4.2K which can be achieved in a conventionally cooled device.

Typically the first and second cooling means are connected by a tube such as a capillary tube. Preferably the capillary tube has an internal diameter of 1–2 mm. The helium coolant may be forced through the cooling circuit by providing a pressurised source of helium coolant.

Preferably one of the first and second cooling means is connected by a first tube (e.g. capillary tube) to the source of liquid helium coolant and the other of the first and second cooling means is connected by a second tube (e.g. capillary tube) to a pump. The pump removes gaseous helium coolant above the liquid level and thus lowers the temperature of the helium coolant.

In a particularly preferable embodiment, the first and second cooling means are part of a cooling circuit which comprises one or more lengths of coiled tube (e.g. coiled capillary tube) which is typically adapted to extend and compress (i.e. decrease and increase respectively the number of coil turns/m) to enable movement of the sample. This is of particular use in an application such as Scanning Tunnelling Microscopy (STM), in which the sample can be moved between a first position in a region of high magnetic field, and a second position in a UHV chamber. Preferably the first and second tubes are both coiled in this way.

Typically the refrigerator further comprises a heater for heating the sorption pump to regenerate the sorption pump.

The capillary tube may be coiled to increase the length of tube between the first and second cooling means—thus decreasing the temperature gradient along the tube between the first and second cooling means. This is of particular importance during regeneration of the sorption pump. Typically the refrigerator further comprises bypass means for bypassing liquid helium coolant around the second cooling means. The bypass means may be a coiled capillary tube. This provides a low hydraulic impedance bypass for liquid helium coolant during regeneration of the sorption pump.

The refrigerator may comprise a dilution refrigerator which uses a $^3$He/$^4$He mixture as refrigerant or a $^3$He refrigerator which uses $^3$He as refrigerant.

The present invention also extends to apparatus for investigating a sample, the apparatus comprising a refrigerator according to the invention for cooling the sample. The apparatus may comprise a particle, X-ray or radiation detector, semi-conductor physics investigation apparatus, neutron scattering experiment, apparatus for magnetic and optical measurement, apparatus for investigating fractional quantised and quantised Hall effect, apparatus for mesoscopic studies, apparatus for investigation of low dimensional systems or apparatus for Scanning Tunnelling Microscopy (STM).

BRIEF DESCRIPTION OF THE DRAWINGS

A number of embodiments of the present invention will now be described and contrasted with conventional refrigerators with reference to the accompanying Figures, in which.

EMBODIMENT

Figure 1:
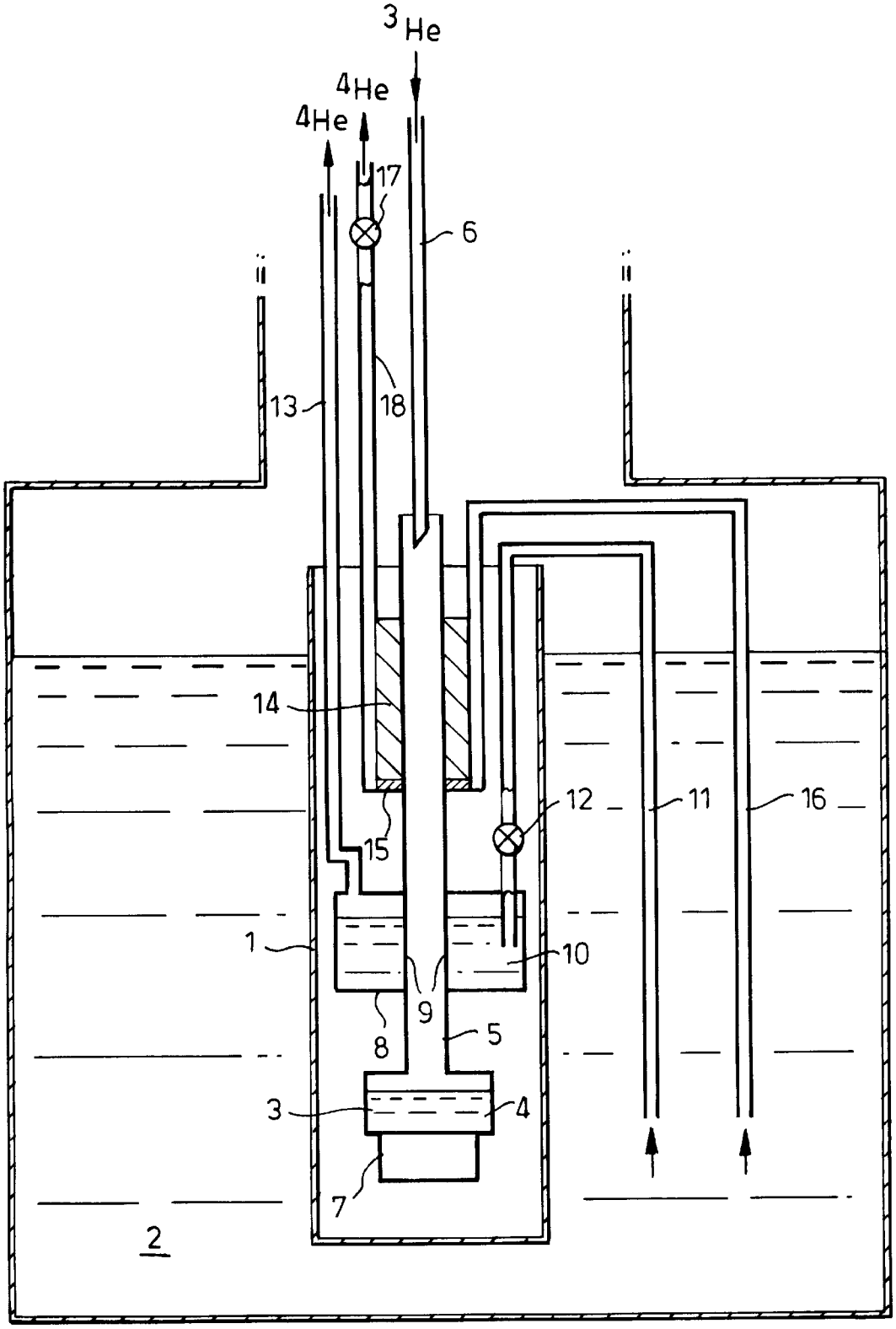
Fig.1. PRIOR ART
FIG. 1 is a cross-section of a conventional $^3$He refrigerator.
Figure 2A:
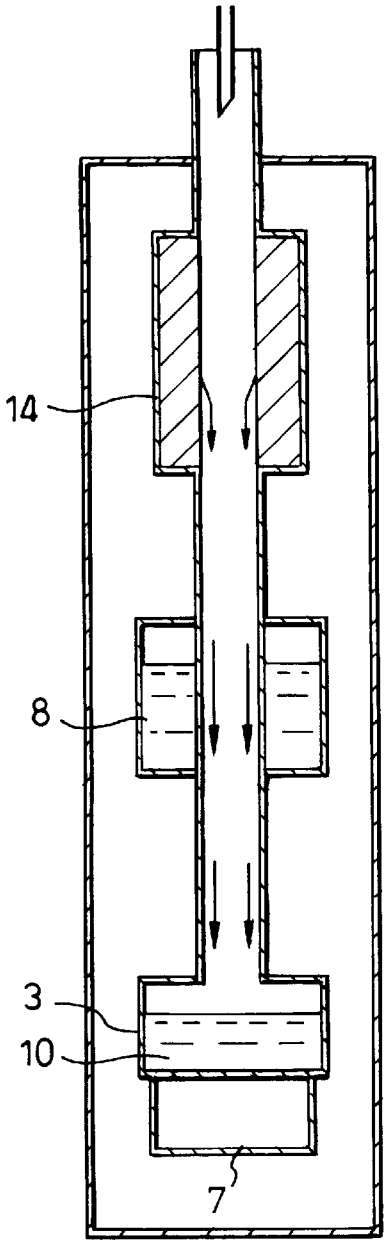
Fig.2A. PRIOR ART
FIG. 2A illustrates the conventional refrigerator of FIG. 1 during condensation.
Figure 2B:
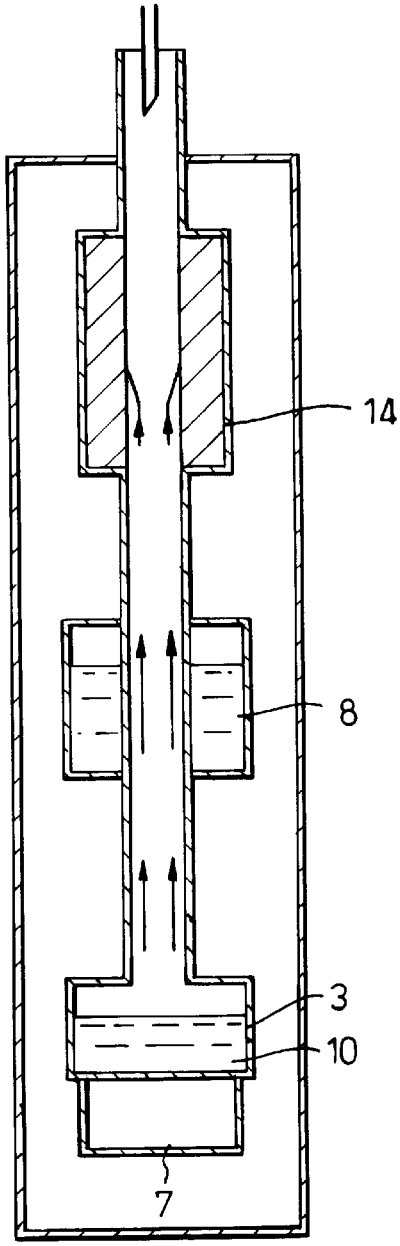
Fig.2B. PRIOR ART
FIG. 2B illustrates the conventional refrigerator of FIG. 1 during pumping.
Figure 3:
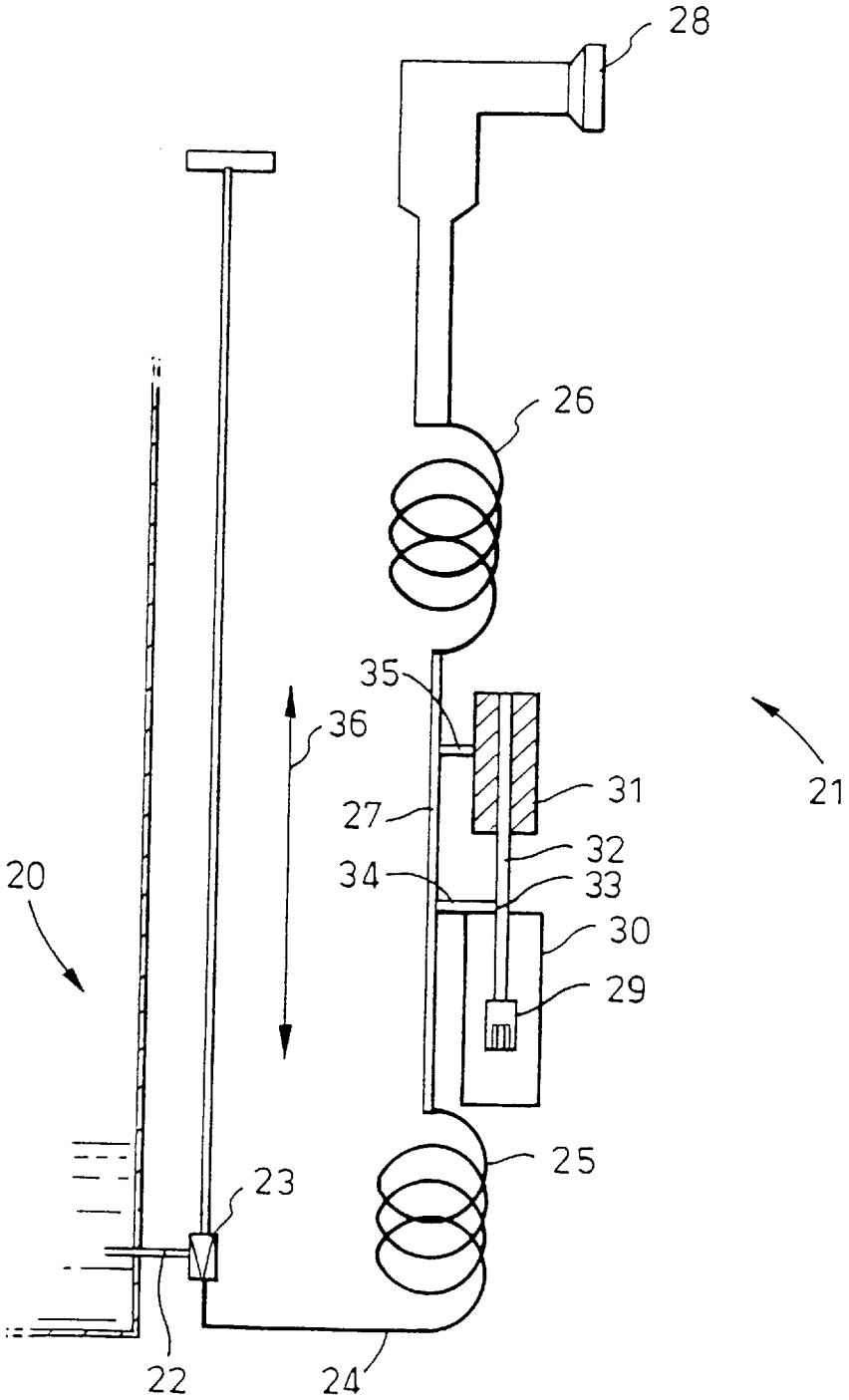
FIG. 3 is a schematic diagram of an example of a $^3$He refrigerator according to the present invention.

FIG. 3 is a schematic diagram of a first embodiment of a $^3$He refrigerator according to the present invention. Main bath 20 contains liquid $^4$He at approximately 4.2K which surrounds the helium insert (generally indicated at 21) and cools it to approximately 4.2K, as well as providing $^4$He coolant. The $^4$He coolant flows through inlet tube 22 and needle valve 23 to capillary tube 24. The capillary tube 24 has a first 4 m long coiled section 25, a second 4 m long coiled section 26 and an intermediate portion 27. The capillary tube 24 is connected at its far end to a rotary pump 28, which pumps off $^4$He gas to lower the temperature of the $^4$He in the capillary to 1–2K. The $^3$He pot 29 contains liquid $^3$He in use to cool a sample (not shown). The $^3$He pot 29 is enclosed in an evacuated 1K shield 30. The $^3$He pot 29 is connected to a sorb 31 via a filling/pumping tube 32. A condensation region 33 of the pumping tube 32 is cooled by suitable heat exchange with the intermediate section 27 of the capillary tube (as indicated schematically at 34). The sorb 31 is cooled by suitable heat exchange (as indicated schematically at 35) with the intermediate portion 27 of the capillary tube. The apparatus between coiled sections 25, 26 can move as a unit as indicated at 36.

Figure 4A:
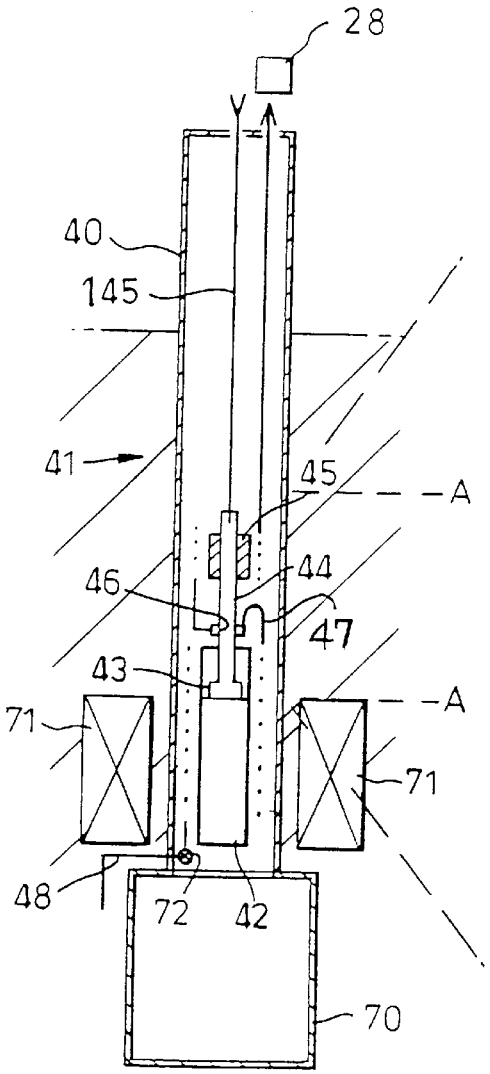
FIG. 4A is a cross-section of STM apparatus incorporating a helium refrigerator of the type shown in FIG. 3.
Figure 4B:
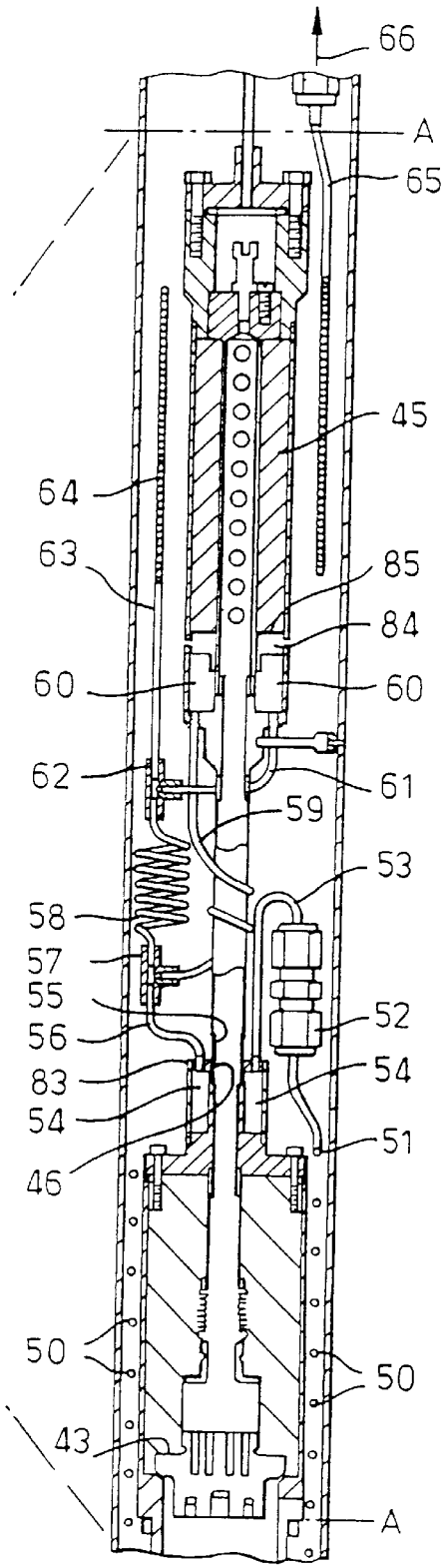
FIG. 4B is a cross-section in the same plane as FIG. 4A, in which a section A—A has been enlarged.

A more detailed embodiment of a system of the type illustrated schematically in FIG. 3 is shown in FIGS. 4A and 4B. FIG. 4A illustrates an evacuated insert 40 immersed in a $^4$He refrigerant bath 41. Sample chamber 42 is mounted below $^3$He pot 43. $^3$He filling/pumping tube 44 is filled with $^3$He via inlet tube 145 (connected to a source of $^3$He not shown). Sorb 45 and condensation region 46 are both cooled by capillary tube 47 which receives $^4$He from the bath 41 via inlet tube 48 and needle valve 72.

Part of the insert 40 between points A—A is illustrated in cross-section in FIG. 4B. The lower half of the capillary tube 47 is coiled round the sample chamber 42 and $^3$He pot 43 as indicated at 50. The last turn 51 of the spiral 50 is connected via a standard connector 52 and capillary tube 53 to a heat exchanger. The heat exchanger comprises an annular chamber 54 which is in heat conducting contact with flange 83 of copper tube 55. Copper tube 55 provides a $^3$He condensation region 46 on its inner surface. The heat exchanger chamber 54 is connected to an outlet capillary tube 56 which is connected in turn to a T-junction connector 57. The T-junction connector 57 is connected in turn to a coiled bypass capillary tube 58 and a coiled capillary tube 59. The capillary tube 59 is connected to a second heat exchanger which cools the sorb 45. The second heat exchanger is of a similar design to the first heat exchanger (54, 55, 83) and comprises an annular chamber 60 in heat conducting contact with a copper ring 84 which in turn is in contact with the lower edge 85 of the sorb material. The heat exchanger chamber 60 is connected in turn to an outlet capillary tube 61 which is connected with the bypass capillary 58 by a second T-junction connector 62. The second T-junction connector 62 is connected in turn to a capillary tube 63 which is coiled at 64 around the sorb 45 and exits at 65. The capillary tube 65 is connected to a rotary pump 28 at the top of the insert 40 in the direction indicated at 66.

All lengths of capillary tube in FIGS. 4A and 4B have an outer diameter of 2 mm and an inner diameter of 1.5 mm.

In the condition shown in FIGS. 4A and 4B, the $^3$He pot 43 is in its raised position. This can be seen by the fact that the lower coil 50 has widely separated turns (i.e. it is in its extended state) and the upper coil 64 has closely spaced turns (i.e. it is in its compressed state). In its raised position the sample holder 42 is positioned in a region of high magnetic field in the bore of a magnet 71. Experimental studies such as Scanning Tunnelling Microscopy (STM) can then be carried out on the sample. On lowering the $^3$He pot 43 and sample holder 42, the lower spiral 50 compresses, and the upper spiral 64 expands. This allows the sample holder 42 to be lowered into a UHV chamber 70.

A typical sequence of operations for operating the apparatus of FIGS. 4A and 4B is as follows:

1) With needle valve 72 open, turn on rotary pump 28, heat sorb 45 with resistance heater (not shown) and fill $^3$He pot 43 and filling/pumping tube 44 with $^3$He. Sorb 45 outgasses $^3$He. Liquid $^4$He will evaporate in heat exchanger chamber 60 and flow through coiled capillary 64 around the sorb and the main flow of liquid $^4$He goes through bypass line 58 (see FIGS. 5B and 5C discussed below). As a result of the heating of the sorb, the impedance of the capillary 59, 61 will be greater than the impedance of the bypass 58 by a factor of 10–30. At that time pot 54 will be filled with liquid $^4$He and cold enough to produce condensation of $^3$He.

2) When sorb 45 is fully regenerated, turn off resistance heater.

3) Flow of $^4$He in capillary starts to cool sorb 45. Cooled sorb 45 pumps off gaseous $^3$He and cools liquid $^3$He in pot 43 down to base temperature.

4) Hold base temperature of approximately 0.3K for approximately 30–50 hours (depending on heat flow to pot 43) until sorb 45 is saturated with $^3$He.

Figure 5A:
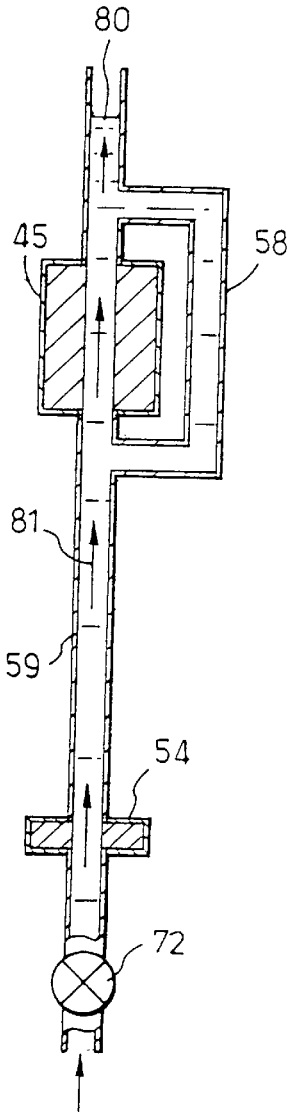
FIG. 5A is a schematic diagram illustrating the flow of liquid helium coolant during cooling.
Figure 5B:
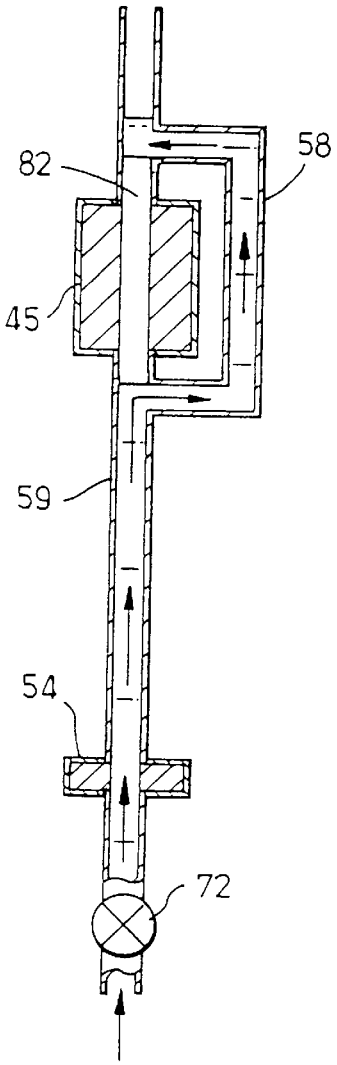
FIG. 5B illustrates the flow of liquid helium through the bypass tube during sorb regeneration.
Figure 5C:
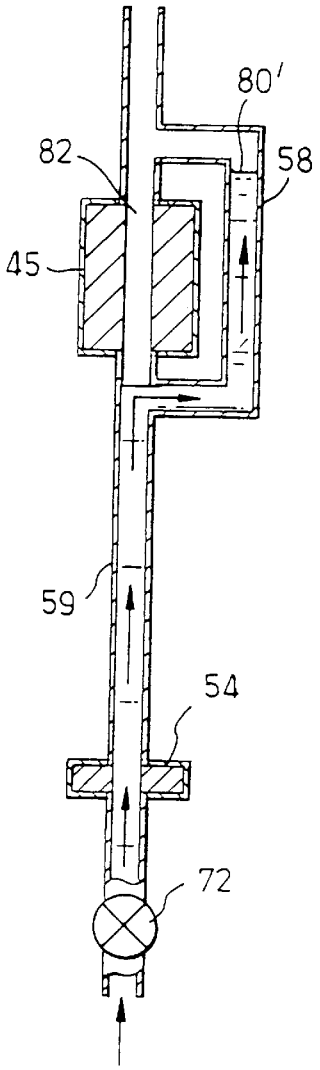
FIG. 5C illustrates an alternative to the flow illustrated in FIG. 5B; and, FIG. 6 is a schematic diagram of an alternative example of a $^3$He refrigerator according to the present invention.

FIGS. 5A, 5B and 5C are schematic diagrams which illustrate the $^4$He liquid level in the cooling capillary tube and the direction of flow of the $^4$He in the cooling tube during cooling of the sorb in the pumping off regime (FIG. 5A) and sorb regeneration (FIGS. 5B and 5C).

FIG. 5A schematically illustrates the cooling line during pumping mode. It can be seen that during cooling the liquid $^4$He level 80 lies above the sorb 45 and above the $^3$He condensation point heat exchanger 54. The flow of $^4$He is illustrated by arrows 81. It can be seen that the predominant flow of liquid $^4$He is through the sorb heat exchanger and not through the bypass tube 58. However, during sorb regeneration the sorb 45 heats up the heat exchanger 60 and causes the liquid helium in the region of the capillary tube indicated at 82 to boil off. Without the bypass tube 58, the liquid $^4$He level 80 would drop to a point between the sorb 45 and the heat exchanger chamber 54, and may even drop below the heat exchanger 54. In addition, heating of the capillary tube will increase the hydraulic impedance to flow of $^4$He. However, by providing a bypass tube 58, a low impedance path is provided round the heated sorb 45 (ie. in parallel with the portion 82 of the capillary tube) since the bypass tube 58 is not heated, resulting in a liquid $^4$He flow as indicated in FIG. 5B. A vapour lock develops in the portion 82 of the capillary tube. Therefore the 1K pot condensation region 46 is kept cold as the $^4$He level does not drop below the condensation region 46.

FIG. 5C illustrates an alternative flow regime in which the liquid level 80' lies below the T-connector 62. In this example, no vapour lock is present in the region 82 and $^4$He evaporates directly around the coiled capillary 64.

Coiling of the capillary tube 59 increases the length between the heat exchanger 54 and the sorb heat exchanger 60, thus decreasing the temperature gradient, in particular during sorb regeneration (FIG. 5B). This helps to ensure that the liquid $^4$He level does not drop below the first heat exchanger chamber 54, which needs to maintain the condensation condition for the $^3$He in condensation region 46.

After condensation when the sorb heater is off and heat load is small the liquid $^4$He level 80 should be at the top end of the capillary tube 65. The total height of liquid $^4$He (i.e. above the opening of inlet tube 48) depends upon the heat load from the top flange of the cryostat. In a particular embodiment of the apparatus, the total length of the capillary tube is approximately 8 meters and the height of liquid $^4$He is approximately 1 meter.

The height will produce a hydrostatic pressure difference between the top of the spiral 64 and the bottom of the spiral 50. The hydrostatic pressure is about 8 torr per metre of height which can cause an increase of the temperature at the bottom of up to 1.8K (assuming that the pressure at the top is 4 torr and the temperature is 1.5K). However, since the $^4$He will be superfluid this will tend to decrease the temperature gradient. The final temperature is typically between 1.5 and 1.8K.

Figure 6:
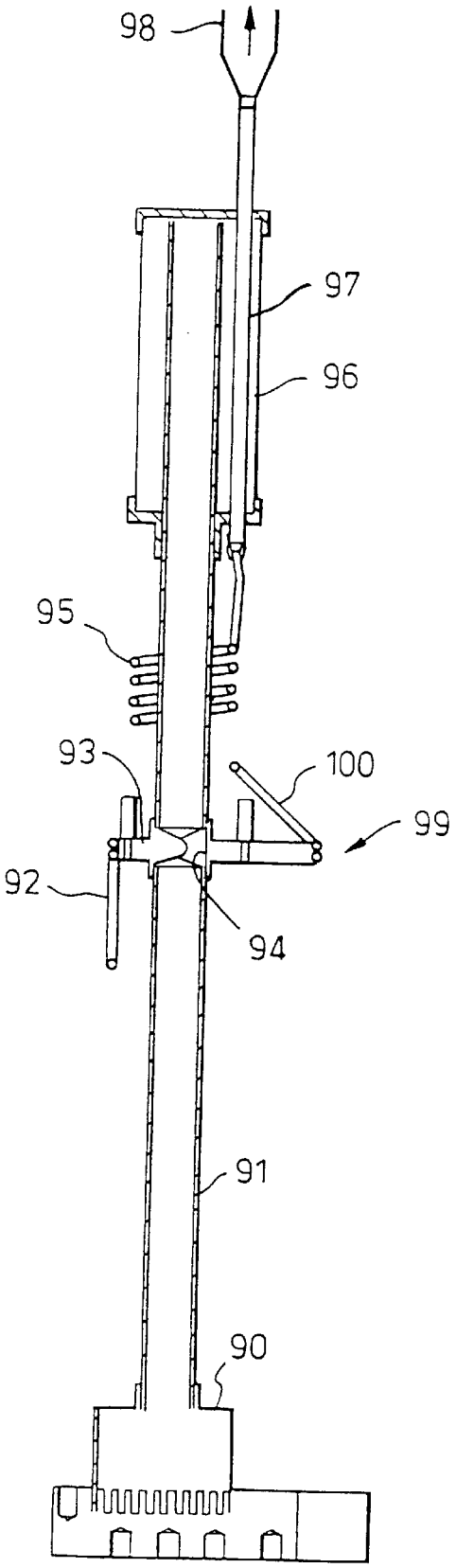

FIG. 6 is a schematic diagram of an alternative example of a $^3$He refrigerator according to the present invention.

$^3$He pot 90 is connected to filling/pumping tube 91. Pick up tube 92 is connected to a 4.2K $^4$He reservoir via a needle valve or fixed impedance (not shown). The pick up tube 92 supplies $^4$He to a 1K platform 99 comprising a capillary tube coiled twice around a copper heat exchanger 93 which provides a $^3$He condensation region on its inner bore 94. The $^4$He cooling circuit continues with a length of capillary 100 which is then coiled four times around the pumping tube 91 at 95. The cooling circuit is then extended into the sorb 96. In this case, the sorb heat exchanger comprises a length of copper tube 97 which has a greater diameter than the capillary tube and passes through the sorb material. The sorb heat exchanger 97 is connected to a rotary pump at 98. The larger diameter and shorter length of the sorb heat exchanger 97 in the embodiment of FIG. 6 ensures that in regeneration mode, evaporation of $^4$He in the region of the sorb will not significantly affect the temperature of the 1–2K platform 99.

I claim:

1. A refrigerator for cooling a sample, comprising:

a container for holding liquid helium refrigerant to cool the sample;

first cooling means connected to a source of liquid helium coolant for cooling a condensation region with said liquid helium coolant, wherein said liquid helium refrigerant condenses on said condensation region and collects in said container;

a sorption pump to pump gaseous helium refrigerant from said container; and second cooling means connected to a source of liquid helium coolant for cooling said sorption pump with said liquid helium coolant, wherein said first and second cooling means are connected in series with said source of said liquid helium coolant.

2. A refrigerator according to claim 1, wherein said first and second cooling means are part of a liquid helium coolant circuit comprising at least one length of coiled tube.

3. A refrigerator according to claim 2, wherein said at least one length of coiled tube extends and compresses to enable movement of the sample.

4. A refrigerator according to claim 1, wherein one of said first and second cooling means is connected to a source of liquid helium coolant and the other of said first and second cooling means is connected to a pump.

5. A refrigerator according to claim 4, wherein said first and second cooling means are each connected to said pump or said source of liquid helium coolant via a length of coiled tube.

6. A refrigerator according to claim 1, further comprising a heater for heating said sorption pump to regenerate said sorption pump.

7. A refrigerator according to claim 1, further comprising bypass means for bypassing said liquid helium coolant around said second cooling means.

8. A refrigerator according to claim 1, wherein said liquid helium coolant comprises $^4$He.

9. A refrigerator according to claim 1, wherein said liquid helium refrigerant comprises $^3$He.

10. A refrigerator according to claim 1, wherein said refrigerator comprises a dilution refrigerator and said liquid helium refrigerant comprises a mixture of $^3$He and $^4$He.

11. A refrigerator according to claim 1, wherein said first and second cooling means are connected by a capillary tube.

12. Apparatus for investigating a sample, said apparatus comprising a refrigerator according to claim 1 for cooling said sample.

13. Apparatus according to claim 12, wherein said apparatus comprises a Scanning Tunnelling Microscope (STM).

* * * * *